US007591457B2

(12) United States Patent
Yoshida et al.

(10) Patent No.: US 7,591,457 B2
(45) Date of Patent: Sep. 22, 2009

(54) PRINTING MEDIUM TRANSPORT APPARATUS AND METHOD AND PRINTING APPARATUS

(75) Inventors: Masahito Yoshida, Shiki (JP); Atsushi Shimizu, Sagamihara (JP); Koji Furusawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 174 days.

(21) Appl. No.: 11/840,605

(22) Filed: Aug. 17, 2007

(65) Prior Publication Data

US 2008/0048383 A1 Feb. 28, 2008

(30) Foreign Application Priority Data

Aug. 23, 2006 (JP) ..... 2006-227180

(51) Int. Cl.
*B65H 5/00* (2006.01)

(52) U.S. Cl. ..... 271/10.01; 271/270; 271/266; 271/10.03

(58) Field of Classification Search ..... 271/264, 271/266, 10.01, 10.03, 10.02, 265.01, 270, 271/228, 229
See application file for complete search history.

(56) References Cited

U.S. PATENT DOCUMENTS

| | | | | |
|---|---|---|---|---|
| 5,738,349 | A * | 4/1998 | Shirasaki | 271/242 |
| 6,135,446 | A * | 10/2000 | Thiemann et al. | 271/228 |
| 6,533,263 | B2 * | 3/2003 | Tamura | 271/10.01 |
| 7,063,472 | B2 * | 6/2006 | Matsuda et al. | 400/579 |
| 7,150,455 | B2 * | 12/2006 | Furukawa et al. | 271/270 |
| 7,357,387 | B2 * | 4/2008 | Asada | 271/110 |
| 7,445,204 | B2 * | 11/2008 | Okamoto | 271/10.02 |
| 2001/0022422 | A1 * | 9/2001 | Tamura | 271/10.03 |
| 2002/0175461 | A1 * | 11/2002 | Ogasawara | 271/10.11 |
| 2004/0188919 | A1 * | 9/2004 | Sakamaki et al. | 271/122 |
| 2005/0017442 | A1 * | 1/2005 | Furukawa et al. | 271/270 |
| 2005/0082735 | A1 | 4/2005 | Nakamura et al. | 271/1 |
| 2005/0082739 | A1 * | 4/2005 | Mitsuya et al. | 271/10.11 |
| 2005/0084308 | A1 | 4/2005 | Nakamura et al. | 399/407 |
| 2005/0104273 | A1 * | 5/2005 | Kim | 271/10.01 |
| 2008/0048383 | A1 * | 2/2008 | Yoshida et al. | 271/109 |

FOREIGN PATENT DOCUMENTS

| | | |
|---|---|---|
| JP | 1-271335 | 10/1998 |
| JP | 2005-67805 | 3/2005 |

* cited by examiner

*Primary Examiner*—Kaitlin S Joerger
(74) *Attorney, Agent, or Firm*—Fitzpatrick, Cella, Harper & Scinto

(57) ABSTRACT

A printing medium transport apparatus and method and printing apparatus which is capable of properly transporting a printing medium by the cooperation of two rollers under independent drive without incurring the complication, size increase and price increase of the apparatus. In the course of transporting a sheet by the cooperation of feed and transport rollers, deceleration/stop control is made on feed and transport motors to be respectively driven such that the rollers are simultaneously stopped from rotating. When the transport roller stops from rotating that is located downstream side on a transport path of a printing medium in case the feed roller is rotating that is located upstream side on the transport path, the feed motor driving the feed roller is forcibly stopped.

10 Claims, 13 Drawing Sheets

PRINTING MEDIUM TRANSPORT APPARATUS AND METHOD AND PRINTING APPARATUS

BACKGROUND OF THE INVENTION

1. Field of the Invention

The present invention relates to a printing-medium transport apparatus and method for transporting a printing medium by use of two rollers to be driven independently, and to a printing apparatus having such a transport apparatus. The invention is suited particularly for use on an apparatus that handles a highly rigid printing medium.

2. Description of the Related Art

In the printing apparatus as represented by the inkjet printer, a feed mechanism is provided to separate one by one a paper sheet as printing medium, from the holder tray and then transport it by a feed roller toward a transport roller. The transport roller is provided in the printing zone where an image is to be printed. In such a feed mechanism, it is a general practice to place the feed and transport rollers under drive control of separate motor drive systems for the purpose of adjusting the sheet feeding conditions and simplifying the drive mechanism.

Such a feed mechanism must be properly set with timing of drive start and stop in consideration of the load burdened on the sheet being transported by the cooperation of the feed and transport rollers.

For example, Japanese Patent Laid-Open No. 2005-67805 discloses a structure that clutches are provided in the respective drive systems for the feed and transport rollers so that the clutch and drive motor, in each drive system, can be controlled associatively. Meanwhile, Japanese Patent Laid-Open No. H1-271335 describes a structure that tension detecting means is provided to detect a tension in a sheet lying between the feed and transport rollers so that the feed and transport rollers can be placed under drive control associatively depending upon the tension in the sheet detected by the tension detecting means.

However, the provision, of such an especial mechanism as a clutch or such an especial detector as tension detecting means as in the existing art, possibly incurs the complication, size increase and price increase of the transport mechanism and ultimately of the resulting printing apparatus.

SUMMARY OF THE INVENTION

The present invention provides a printing-medium transport apparatus and method and printing apparatus capable of properly transporting a printing medium by the cooperation of two rollers to be independently driven without incurring the complication, size increase and price increase of the apparatus.

In a first aspect of the present invention, there is provided a transport apparatus for transporting a printing medium through a transport path by cooperation of a first roller located upstream side on the transport path and a second roller located downstream side on the transport path, the transport apparatus comprising: a first drive system that drives the first roller by a first drive motor; a second drive system that drives the second roller by a second drive motor; and control means that places the first and second drive motors under deceleration/stop control respectively to simultaneously stop the first and second rollers from rotating, in a course of transporting the printing medium by cooperation of the first and second rollers; wherein the control means forcibly stops the first drive motor in a case the first roller is rotating when the second roller stops from rotating.

In a second aspect of the present invention, there is provided a transport method for transporting a printing medium through a transport path by cooperation of a first roller located upstream side on the transport path and a second roller located downstream side on the transport path, the transport method comprising the steps of: driving the first roller by a first drive motor; driving the second roller by a second drive motor; placing the first and second drive motors under deceleration/stop control respectively to simultaneously stop the first and second rollers from rotating, in a course of transporting the printing medium by cooperation of the first and second rollers; and forcibly stopping the first drive motor in a case the first roller is rotating when the second roller stops from rotating.

In a third aspect of the present invention, there is provided a printing apparatus comprising: a transport apparatus according to the first aspect of the present invention; and a printing portion where an image is to be printed on a printing medium being transported through the transport path.

According to the invention, the first and second drive motors, under separate driving to those, are placed under deceleration/stop control to stop simultaneously the first and second rollers from rotating, in the course of transporting a printing medium by the cooperation of first and second rollers. Where the first roller located upstream on the printing-medium transport path is rotating upon a stop of the second roller located downstream on the transport path, the first drive motor is forcibly stopped. Owing to controlling the first and second drive motors in this manner, the printing medium can be properly transported without incurring any complication, size increase and price increase of the apparatus. Specifically, the printing medium can be suitably transported without applying such an excessive load as a tension to the printing medium or without applying an excessive load to the drive motor where transporting a printing medium particularly high in rigidity.

Further features of the present invention will become apparent from the following description of exemplary embodiments with reference to the attached drawings.

DESCRIPTION OF THE EMBODIMENTS

With reference to the drawings, description will be now made on embodiments according to the present invention.

First Embodiment

Figure 1:
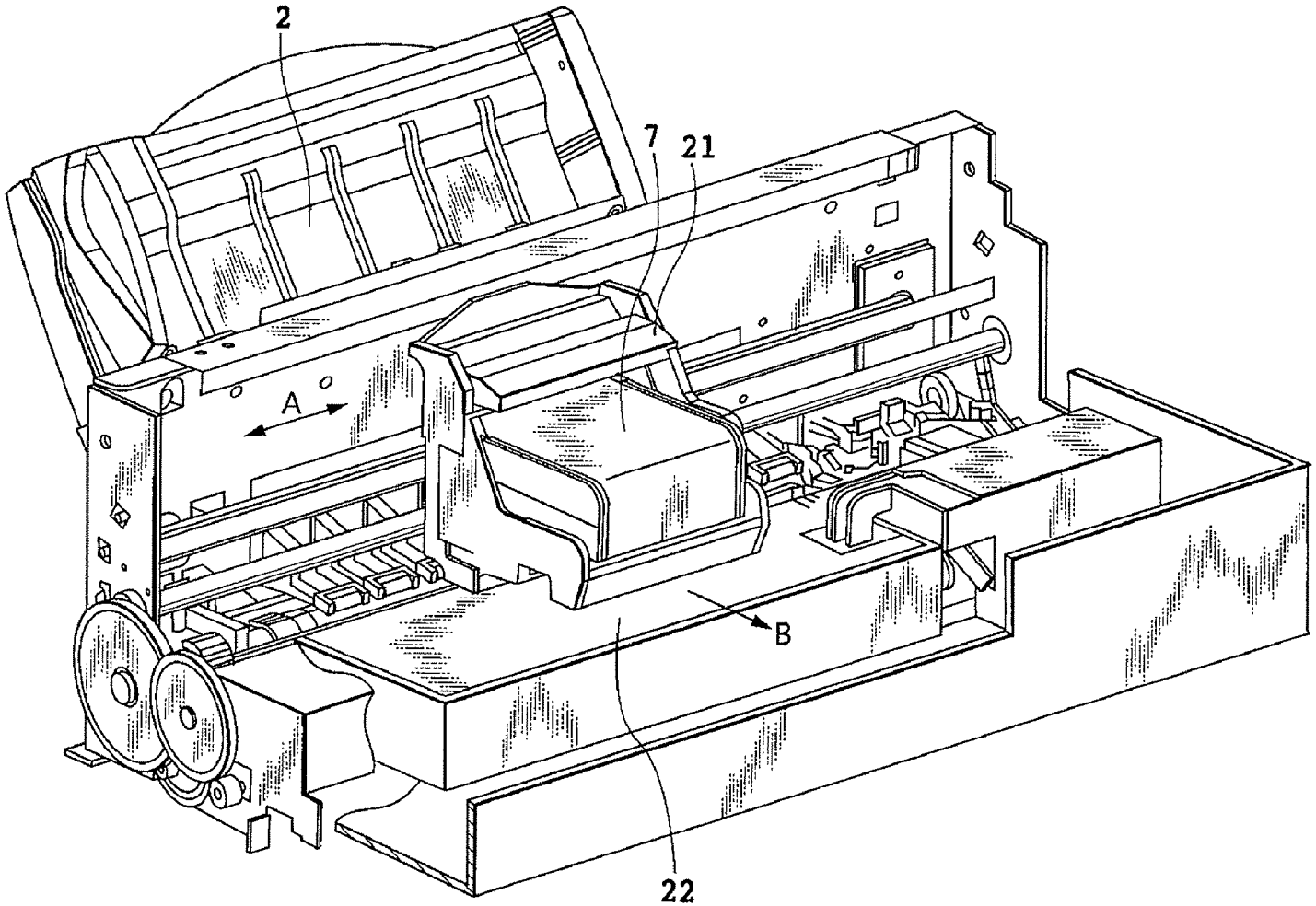
FIG. 1 is a perspective view for explaining an interior construction of an inkjet printing apparatus according to a first embodiment of the present invention.
Figure 2:
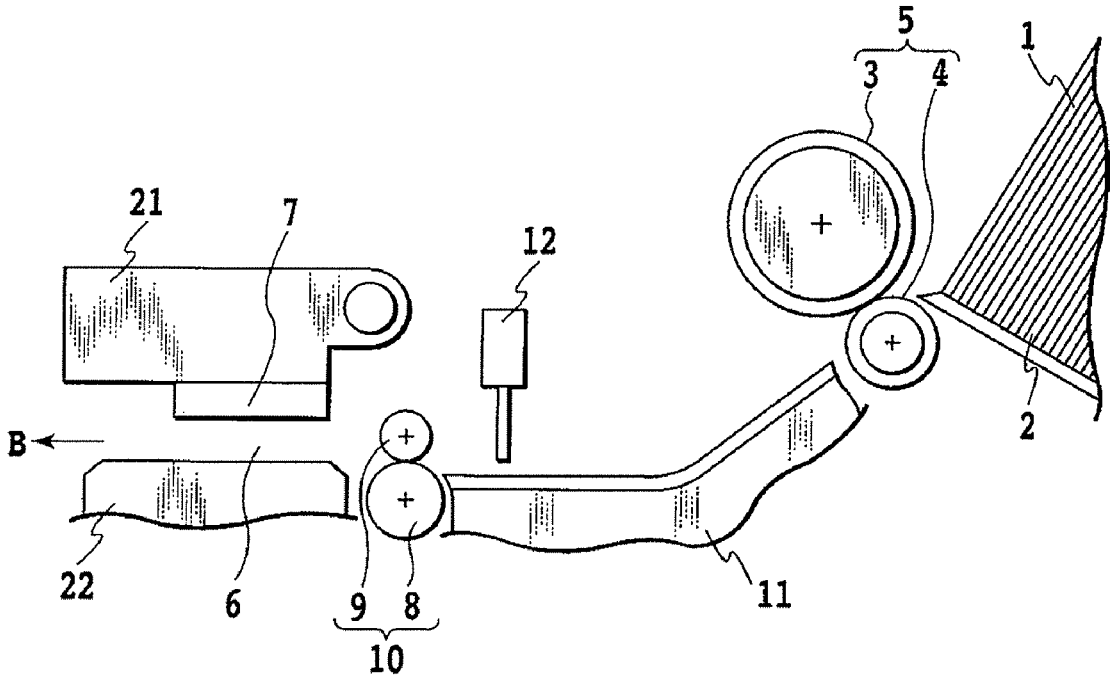
FIG. 2 is a schematic side view of a feed mechanism of the inkjet printing apparatus in FIG. 1.
Figure 3:
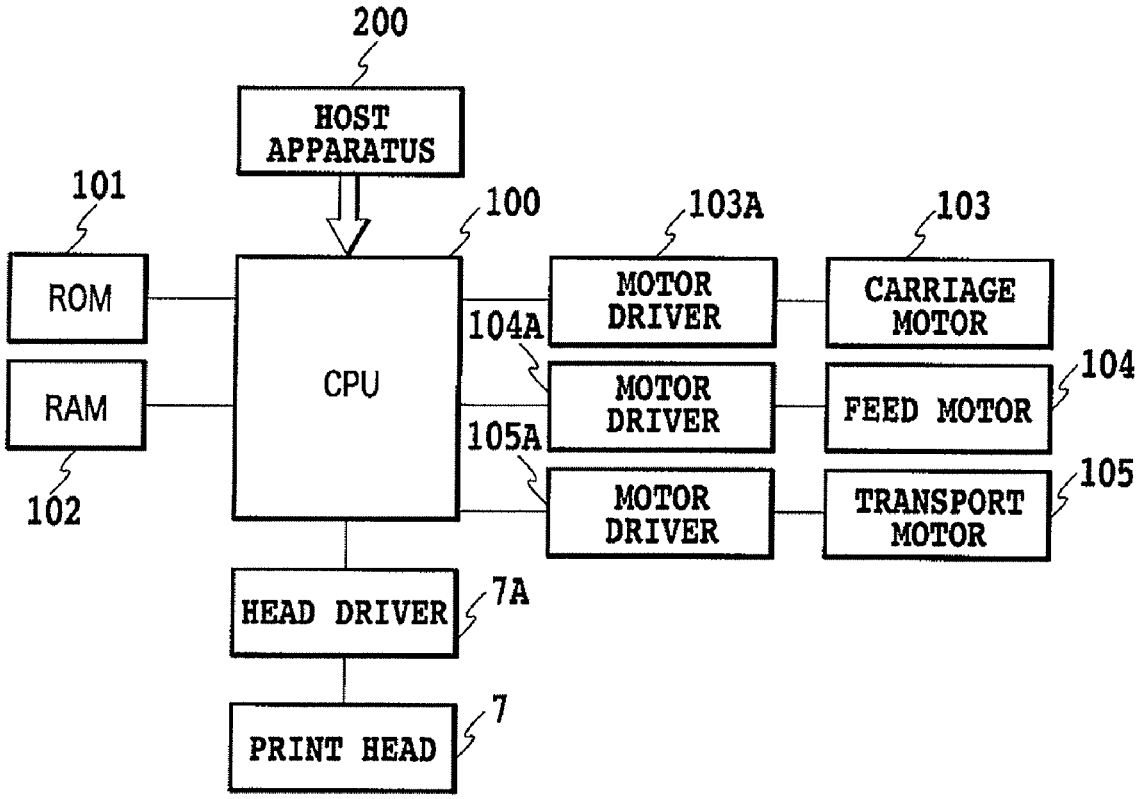
FIG. 3 is a block configuration diagram of a control system of the inkjet printing apparatus in FIG. 1.

FIG. 1 is a schematic perspective view for explaining the interior construction of an inkjet printing apparatus of a serial scan system to which the invention can be applied. FIG. 2 is a schematic side view for explaining a structural example of a feed mechanism provided on the printing apparatus. FIG. 3 is a block configuration diagram of a control system of the printing apparatus.

An inkjet print head (printing means) 7, capable of ejecting ink, is removably mounted on a carriage 21 movable in a main scanning direction along an arrow A. The print head 7 may constitute an inkjet cartridge together with an ink tank. As shown in FIG. 2, a printing zone 6 is formed at between the print head 7 and a platen 22. A sheet 1, as a printing medium, is to be transported in a sub-scanning direction shown at an arrow B, along a transport path passing through the printing zone 6. By repeating the ejection of ink at the print head 7 moving in the main scanning direction and the transport of the sheet 1 in the sub-scanning direction, an image is printed in order on the sheet 1.

The sheets 1, stacked on a holder tray 2, are to be separated one by one and fed onto the transport path by means of a feed roller (first roller) 3 and a separating roller 4 that constitute a feeding roller pair 5. The feed roller 3 is to be rotated by a feed motor 104 (see FIG. 3) while the separating roller 4 touches the feed roller 3. In the vicinity of the printing zone 6, a transport roller (second roller) 8 and a driven roller 9 are provided constituting a transport roller pair 10. The transport roller 8 is to be rotated by a transport motor 105 (see FIG. 3) while the driven roller 9 touches the transport roller 8. The sheet 1 is to be held by the feed roller pair 5 and fed to the printing zone 6. In this manner, the feed roller 3 and the transport roller 8, as described below, are to be driven separately by respective motor driving systems, in order to adjust the feeding conditions and simplify the drive mechanism.

Between the transport roller pair 10 and the feed roller pair 5, a guide portion 11 is arranged including a rib to guide the sheet 1 at its leading edge. In a position above the guide portion 11 and upstream the transport roller pair 10 with respect to the transport direction, a sheet-edge sensor 12 is arranged to detect the leading edge of the sheet 1.

The feed roller 3 generally uses a rubber-made roller formed non-rigid and highly frictional, in order to draw the sheet 1 out of the holder tray 2. Meanwhile, the transport roller 8 uses a roller formed by a metal shaft polished on its surface in order to improve the transport accuracy of the sheet 1 at the printing zone 6. The transport roller 8 is set with a sheet-transport power higher than that of the feed roller 3.

In FIG. 3, a CPU 100 is to perform control processing of motions, data processing, etc. for the printing apparatus. A ROM 101 stores a program for those processing, and a RAM 102 is to be used as a work area for executing such processing. Ink is ejected from the print head 7 by driving an ejection-energy producing element of the print head 7 by means of the CPU 100 depending upon printing data. The ejection-energy producing element can use an electrothermal conversion element (heater) or a piezoelectric element. Where using the electrothermal conversion element, bubble is caused in ink by heat generation so that ink can be ejected through an ink ejection port by utilization of the energy of bubble generation. Printing data is to be inputted from a host apparatus 200 in the form of a computer or the like. Through a motor driver 103A, the CPU 100 controls the carriage motor 103 to move the carriage 21 in the main scanning direction. Meanwhile, through motor drivers 104A and 105, the CPU 100 controls the feed motor (first drive motor) 104 and transport motor (second drive motor) 105 as described below, according to the program stored in the ROM 101.

Figure 4:
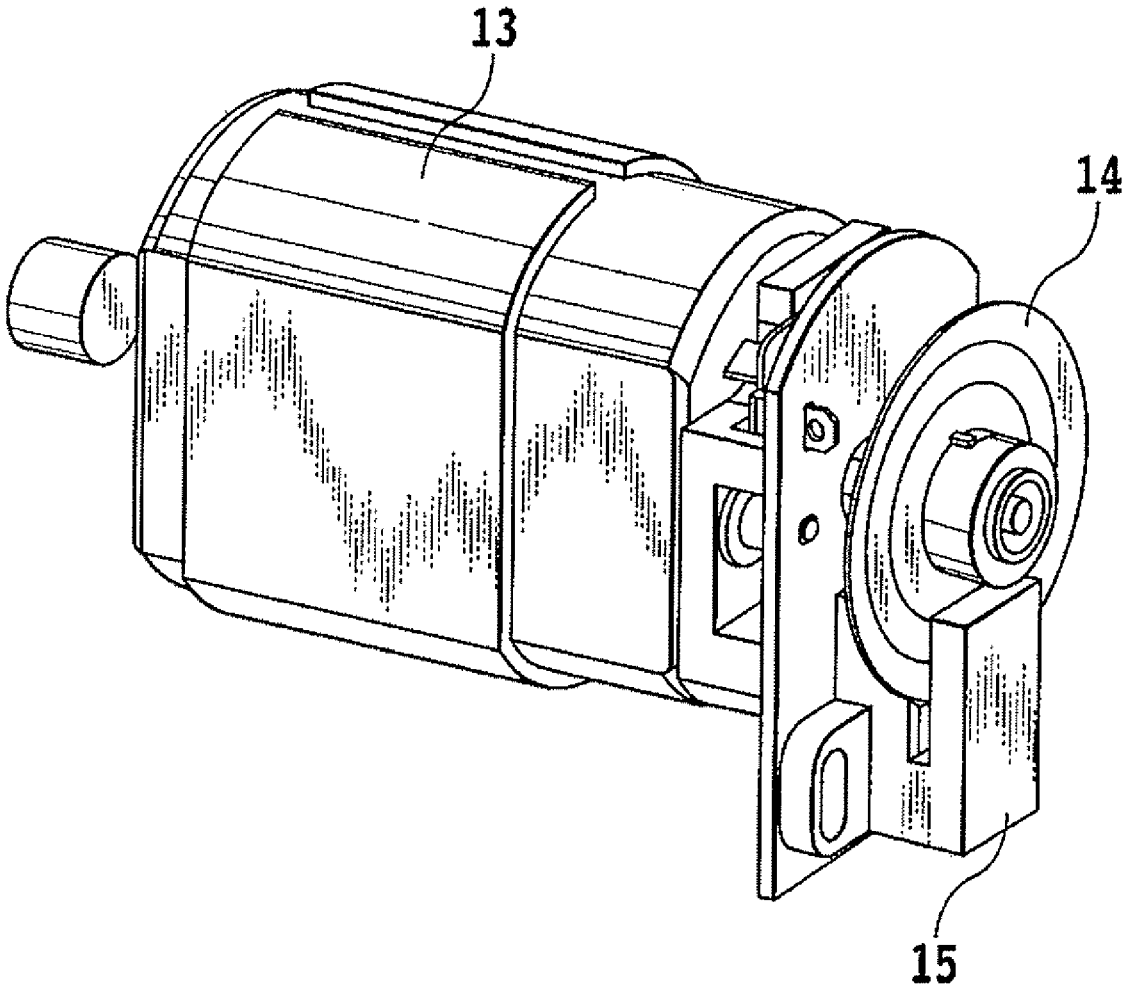
FIG. 4 is a perspective view of a DC motor applicable as a feed motor and transport motor in FIG. 3.

The feed motor 104 and the transport motor 105 can use a DC motor 13 as shown in FIG. 4.

The DC motor 13 is provided with an optical encoder wheel 14 on a rotary shaft thereof. In a fixing portion of the DC motor 13, an optical sensor 15 is provided to detect encoder slits formed in the wheel 14. The rotation number of the DC motor 13 can be detected depending upon a detection signal of the encoder slits detected by the optical sensor 15. In order to detect the rotation number of the DC motor 13, the encoder may be provided in a drive system at between the DC motor 13 and the rollers (feed roller 3 and transport roller 8).

The rotation number per unit time can be detected as to the DC motor 13 by measuring the detection interval of the encoder slits by use of the optical sensor 15. The rotation speed can be adjusted by regulating the application voltage to the DC motor 13 placed under feedback control. The optical sensor 15, using a two-channel type whose output is deviated in phase, also can detect a rotating direction of the DC motor 13.

(Drive System Particularity for Feed and Transport Rollers 3, 8)

In this manner, the drive systems for the feed and transport rollers 3, 8 are structured independently from each other, whose drive systems have respective DC motors 13 to be placed under servo control separately. In the drive systems for the two DC motors 13, there is a possibility to cause a difference in the inertia moment on the elements lying from the DC motor 13 to the rollers (feed and transport rollers 3, 8) and in the output characteristics of the two DC motors 13. Because the difference of between the drive systems is influential particularly upon the acceleration and deceleration time of the rollers (feed and transport rollers 3, 8), there is a difficulty in decelerating and stopping the two DC motors 13 at the same time.

In addition to such a difference of between the drive systems, there is a possibility to cause a transport amount difference of the sheet 1 at between the rollers resulting from the frictional force difference of between the two types of rollers (feed and transport rollers 3, 8). This readily causes a looseness or tightness in the sheet 1 at between the feed and transport roller pairs 5, 10 due to the push or pull of the sheet 1.

Pushing a sheet 1 refers to a state that feed amount is excessive at the feed roller 3 relative to the transport roller 8 whereas pulling a sheet 1 refers to a state that feed amount is deficient at the feed roller 3 relative to the transport roller 8. It is generally considered preferable that the sheet 1 is suitably loose under the condition not to cause, in the sheet 1, wrinkles, folds and tightness in a push direction. For this reason, a space is formed to provide a proper looseness in the sheet 1, on the guide portion 11 constituting the sheet path extending between the feed roller 3 and the transport roller 8. This can prevent the sheet 1 from being tightened by pulling thereof. The existence of proper flexure in the sheet 1 provides an effect to eliminate the effect of feed accuracy caused by the feed roller 3 contrary to the transport roller 8 requiring transport accuracy.

Meanwhile, it is desirable to eliminate the tightness, constituting a load in the sheet 1, in both the push and pull directions of the sheet 1 at a start of accurately transporting the sheet 1. Namely, when the sheet 1 is transported to the printing zone 6 by the cooperation of the feed and transport rollers 3, 8 (hereinafter, referred also to as "cooperative transport") followed by being accurately transported for printing, the feed roller pair 5 is preferably released of its transport force thereby eliminating the tightness from the sheet 1. For this reason, there are cases to use a structure that the rotation amount of the feed roller 3 is regulated by means of a cam or the like so that the feed roller 3 can be released of its drive/transport force after cooperatively transporting the sheet 1 a given amount.

However, where rectifying a skew of the sheet 1 depending upon the type thereof as referred later, the feed and transport rollers 3, 8 stop simultaneously in timing in various ways. Accordingly, in such various situations the feed and transport rollers 3, 8 stop simultaneously, the transport force must be maintained at the feed roller 3. Namely, there is a need to retain a tail portion of the sheet 1 by means of the feed roller pair 5, in the upstream of the transport roller pair 10 with respect to the sheet transport direction. In this case, the feed roller 3 is difficult to be controlled by the utilization of a cam and the like.

Furthermore, the feed mechanism recently has reduced in size wherein a rigid special sheet is required to handle as the sheet 1, or printing medium. In the specifications of such a feed mechanism, there is a difficulty in securing a sufficient space allowing the sheet 1 to sag. The printing medium, if highly rigid, is placed in a situation ready to cause a tightness without obtaining a less effect of such sagging wherein a great influence encounters even where slight is the difference of transport amount of the printing medium between the feed roller 3 and the transport roller 8. For example, where the transport roller 8 stops earlier than the feed roller 3 after cooperatively transporting a rigid printing medium, the printing medium cannot be fed by the feed roller 3 being decelerated. In this case, the drive system to the feed roller 3 becomes possibly inoperative because of load applied thereto. Where allowance is less given to the backlash or mechanism strength of a drive system reduced in size, the sheet 1 possibly undergoes the effect of tightness loading in the push direction thereof during cooperative transport of the sheet 1. Namely, immediately after the feed and transport rollers 3, 8 are stopped, spring-back action takes place at the feed mechanism thereby possibly shifting the feed roller 3 or the sheet 1.

(Control Example of Feed and Transport Motors 104, 105)

Figure 5:
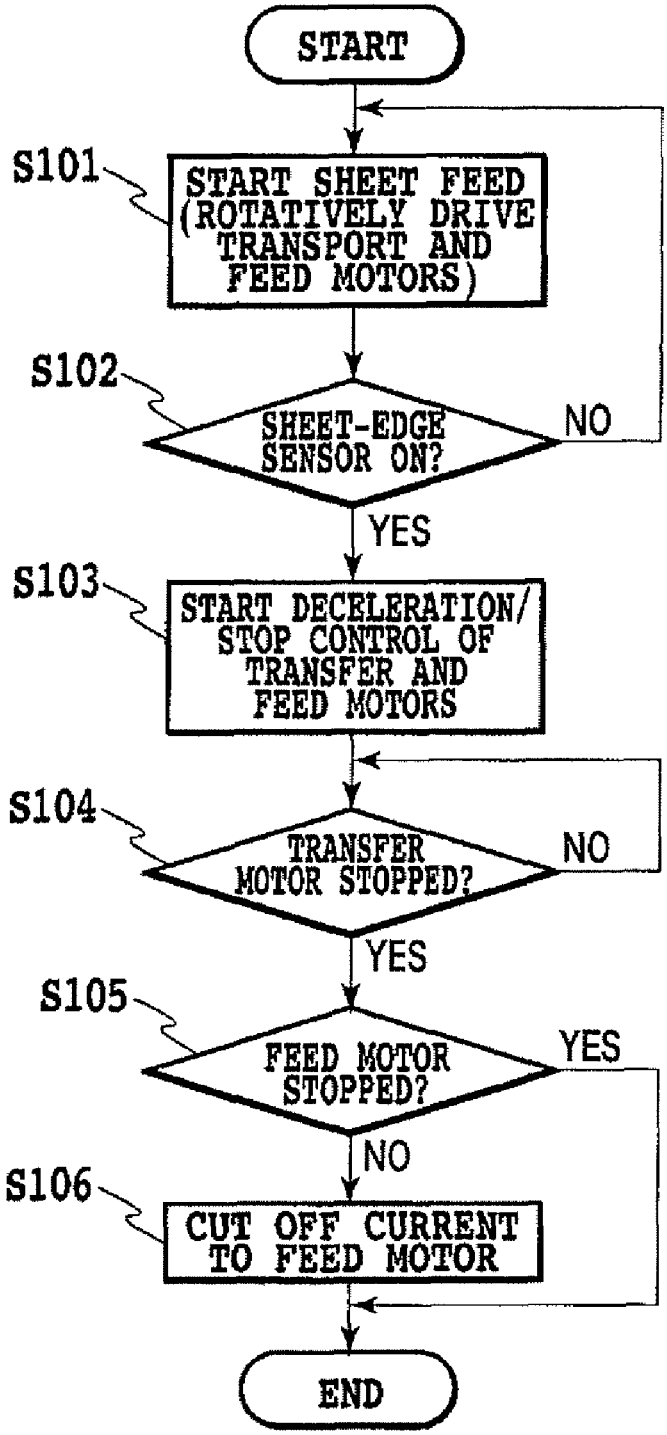
FIG. 5 is a flowchart for explaining the principal processing in motor control according to the first embodiment of the invention.

FIG. 5 is a flowchart for explaining the feed stop control of the sheet 1 to be performed at a time of detecting the leading edge of the sheet 1 by the sheet-edge sensor 12 after starting to cooperative transport the sheet 1 by the cooperation of the feed and transport rollers 3, 8. The control procedure constitutes a part of a control processing of a series of sheet feed operations (including those upon printing) of the sheet 1.

Figure 6:
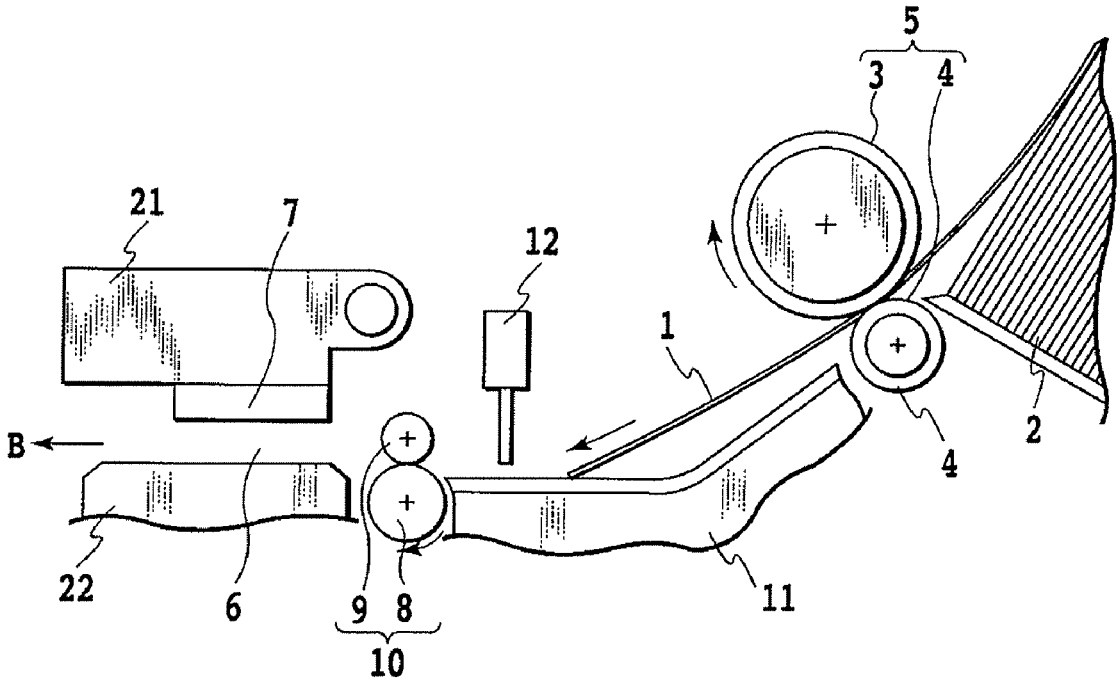
FIG. 6 is an explanatory figure showing a state of sheet feeding by a feed roller in the feed mechanism in FIG. 2.

In the outset, at step S101, the feed and transport rollers 3, 8 are started to rotate respectively by the feed and transport motors 104, 105. The sheet 1, separated out of the holder tray 2, is fed in the arrow direction by the rotation of the feed roller 3, as shown in FIG. 6. At this time, the feed speed of the sheet 1 is equal at the feed roller 3 and at the transport roller 8. The sheet 1, being fed by the feed roller 3, is moved along the guide portion 11 and advanced toward the transport roller 8. The sheet 1, as described below, is detected at its leading edge by the sheet-edge sensor 12 and then caught at the leading edge by the nip of the transport roller pair 10.

When the sheet-edge sensor 12 detects the leading edge of the sheet 1 and turns on, the process proceeds from step S102 to step S103 in FIG. 5, thus starting deceleration/stop control as to the feed and transport motors 104, 105. Namely, a deceleration/stop command is issued to decelerate and stop the motors such that, after the sheet-edge sensor 12 detects the leading edge of the sheet 1, the feed and transport rollers 3, 8 are rotated equal in transport amount and then the feed and transport motors 104, 105 are stopped at the same time. The transport amount, in this case, is given as a specified amount established by a detection signal related to the encoder slits.

Figure 7:
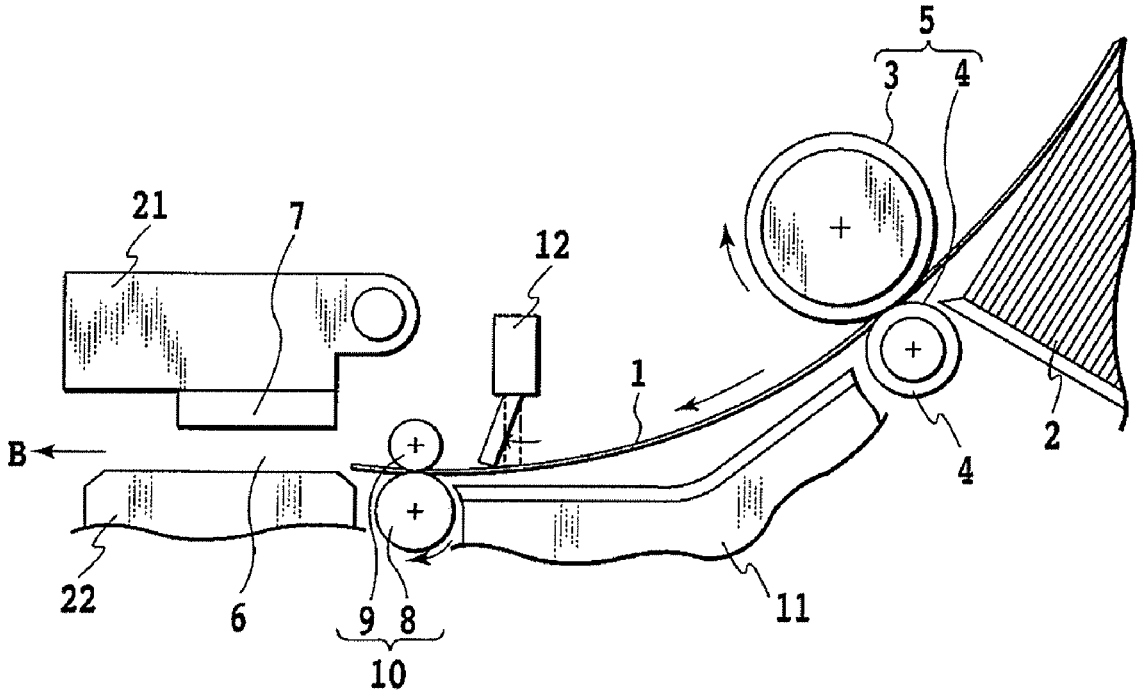
FIG. 7 is an explanatory figure showing a state of sheet feeding by cooperation of the feed roller and a transport path in FIG. 2.

By means of the deceleration/stop command, the sheet 1 comes to a rest in a state being fed a somewhat amount in the arrow direction after caught at the leading edge by the nip of the transport roller pair 10, as shown in FIG. 7. Namely, the feed and transport rollers 3, 8 go into stop simultaneously after the sheet 1 is caught at the leading edge by the nip of the transport roller pair 10 and then fed somewhat in amount by the cooperation thereof.

At the next step S104, it is determined whether or not stop control on the transport motor 105 has completed, i.e. whether or not the transport motor 105 has stopped. In the case the transport motor 105 has stopped, it is determined whether or not stop control of the feed motor 104 has completed, i.e. whether or not the feed motor 104 has stopped. In the case the feed motor 104 has stopped, the FIG. 5 process is terminated. Accordingly, in the case the feed motor 104 is at stop when the transport motor 105 is in stoppage, the FIG. 5 process is terminated.

Meanwhile, in the case the feed motor 104 is not yet stopped at the time of step S105, the current supply is shut off to the feed motor 104. Namely, after issuing a command to forcibly terminate the deceleration/stop control on the feed motor 104, the FIG. 5 process is terminated.

Figure 8:
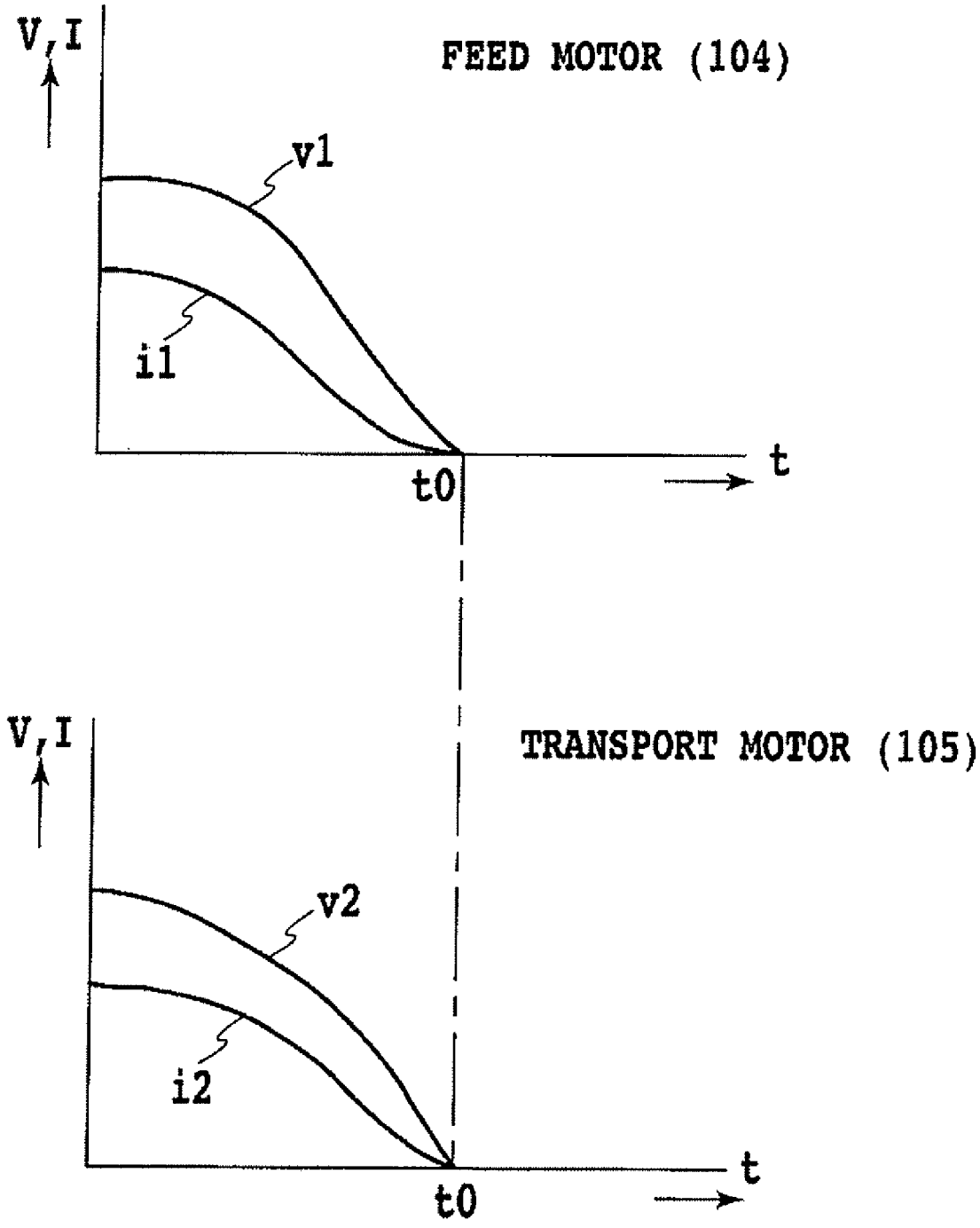
FIG. 8 is an explanatory figure showing an example of stop timing at the feed and transport motors in FIG. 3.
Figure 9:
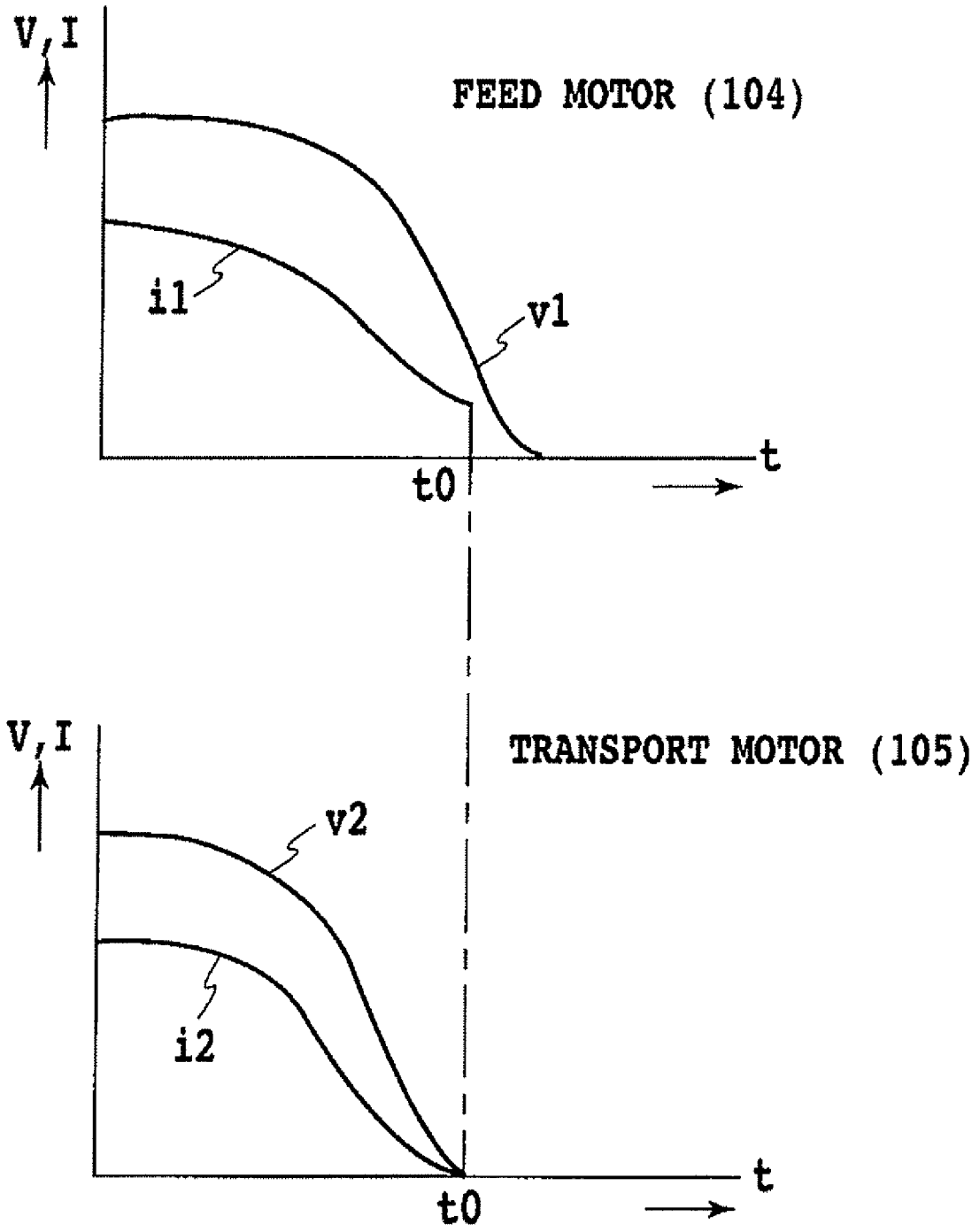
FIG. 9 is an explanatory figure showing another example of stop timing at the feed and transport motors in FIG. 3.
Figure 10:
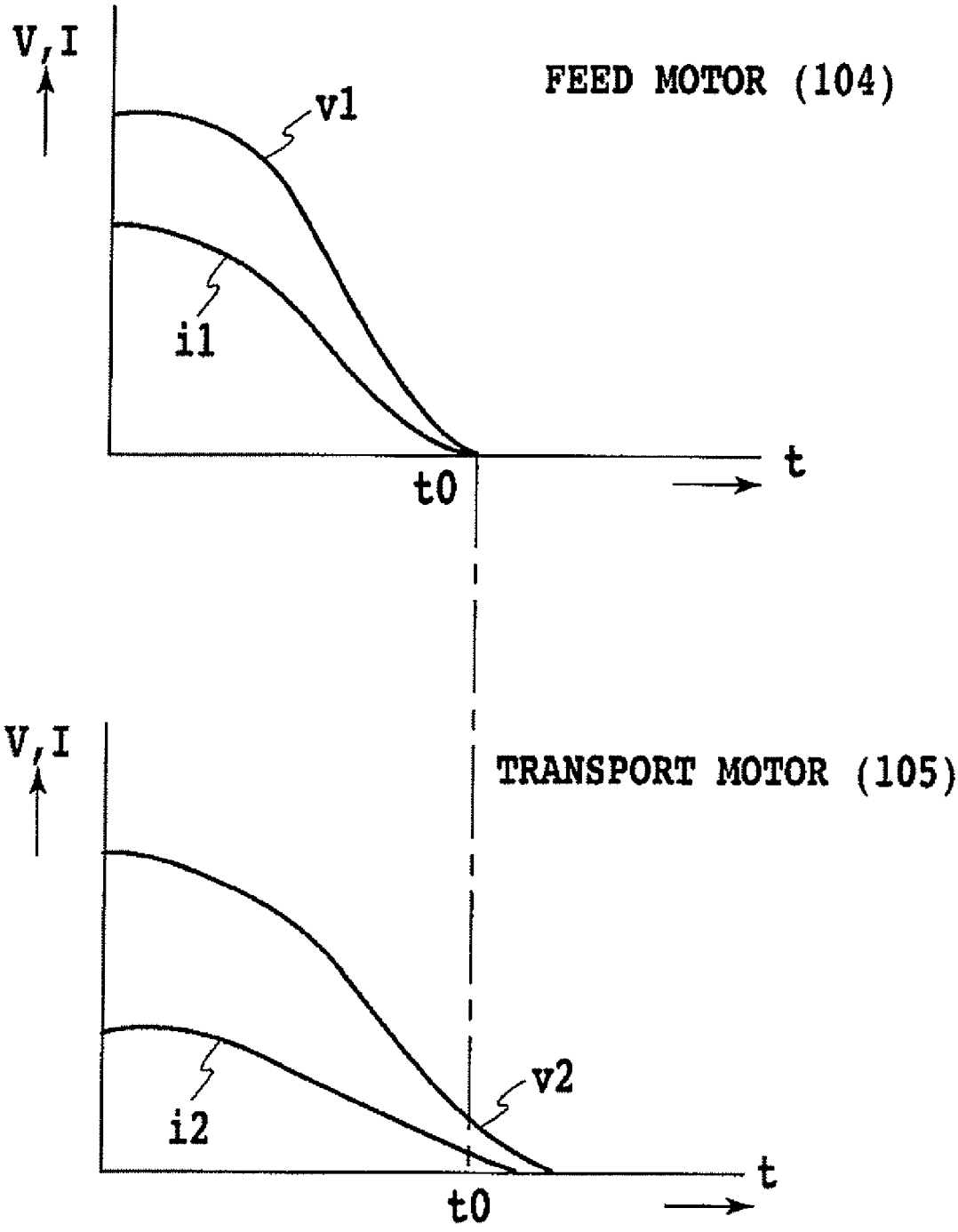
FIG. 10 is an explanatory figure showing still another example of stop timing at the feed and transport motors in FIG. 3.

FIGS. 8 to 10 are figures for explaining a change of rotation speed V and application current I under the deceleration/stop control of the feed and transport motors 104, 105. In the figures, time t is taken on the abscissa while the rotation speed V detected by the encoder and the application voltage I under control are taken on the ordinate. The speed of and application voltage to the feed motor 104 are shown at v1 and i1 while the speed of and application voltage to the transport motor 105 is shown at v2 and i2.

FIG. 8 shows a case that the feed motor 104 stops at the time point t0 that the transport motor 105 stops. In FIG. 8, the change of speed is ideal wherein stop timing is identical between the feed motor 104 and the transport motor 105, thus cooperatively transporting the sheet 1 smoothly. In this case, the FIG. 5 process is terminated without proceeding the process from step S105 to step S106 in FIG. 5.

FIG. 10 shows a case that the feed motor 104 comes to a stop earlier in timing than the transport motor 105 wherein the transport roller 8 stops later than the feed roller 3. However, because transport force is greater at the transport roller 8 than the feed roller 3, the difference between those causes a slippage at between the feed roller 3 and the sheet 1, thus not raising a trouble in driving the transport motor 105. In this case, the FIG. 5 process is terminated similarly to the FIG. 8 ideal situation without proceeding the process from step S105 to step S106 in FIG. 5.

FIG. 9 shows a case that the transport motor 105 comes to a stop earlier in timing than the feed motor 104. For example, where the transport roller 8 stops earlier during transporting a rigid sheet 1, the sheet 1 cannot be fed by the feed roller 3 being decelerated. In such a case, the feed drive system including the feed motor 104 possibly becomes inoperative because of load applied thereto. Accordingly, in this case, the process proceeds from step S105 to step S106 in FIG. 5 where application voltage i1 is cut off to the feed motor 104 being decelerated, thus interrupting the deceleration servo control on the feed motor 104. Due to this, the feed motor 104 stops after decelerated on inertia.

By thus executing the FIG. 5 processing, the deceleration/stop control is completed as to the transport motor 105 regardless of the stop timing of the feed and transport motors 104, 105. Thus, accurate management is available as to the stop position of the sheet 1.

After stopping the sheet 1 as shown in FIG. 7, the feed and transport rollers 3, 8 are driven simultaneously. By the cooperation of those, the sheet 1 is transported (cooperatively transported) to the printing zone 6 at its print start point. Thereafter, image printing is made onto the sheet 1 being intermittently fed by the cooperation of the feed and transport rollers 3, 8. The FIG. 5 processing can be executed in any operation of the printing apparatus. Namely, the FIG. 5 processing may be executed at any time provided that they are stopped at the same time during cooperative transport (including during skew rectification, referred later) of the sheet 1.

(Skew Rectification)

Before or after a stop of the sheet 1 as shown in FIG. 7, skew rectification can be made to rectify the skew of the sheet 1.

For example, before stopping the sheet 1 as shown in FIG. 7, the skew of the sheet 1 is rectified by pushing the leading edge of the sheet 1 into the nip of the transport roller pair 10 through use of the transport force of the feed roller 3. Namely, the skew is rectified by abutting the leading edge of the sheet 1 against the transport roller 8 being stopped from rotation. As another example of skew rectification, there is a method that the transport roller 8 is rotated reverse while keeping the feed roller 3 at stop after the leading edge of the sheet 1 is once caught in the nip of the transport roller pair 10 by the cooperation of the feed and transport rollers 3, 8. In such a case, the amount of reverse rotation of the transport roller 8 is given greater than the catch amount of the sheet 1 in the transport roller pair 10. This method can relieve the load imposed upon abutting the leading edge of the sheet 1 and improve the effect of rectifying the skew of the sheet 1. After rectifying the skew of the sheet 1 by reverse rotating of the transport roller 8 in this manner, the sheet 1 is fed to the printing region 6.

Those methods of skew rectification are to be applied depending upon sheet type, etc. wherein it can cope with a change of rotation speed or amount of the roller even on the same printing apparatus.

Second Embodiment

Figure 11:
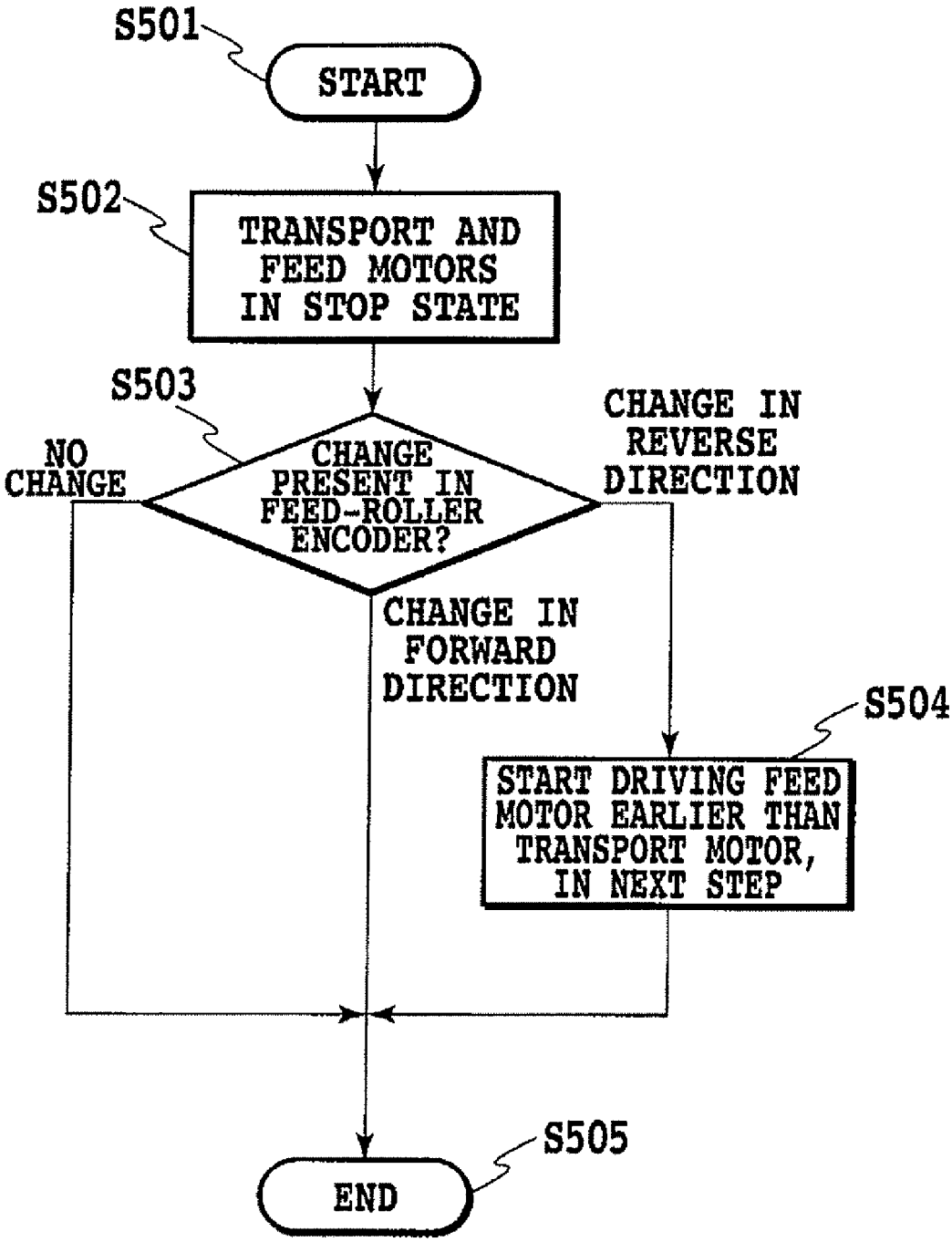
FIG. 11 is a flowchart for explaining the principal processing in motor control according to a second embodiment of the invention.

FIG. 11 is a flowchart for explaining control to perform after stopping the sheet 1 from moving by the cooperation (cooperative transport) of the feed and transport rollers 3, 8. The control procedure constitutes a part of the control processing of a series of feed operations (including those in printing) of the sheet 1.

At the time of step S501 where to start the FIG. 11 process, the feed and transport rollers 3, 8 have already completed the cooperative transport of the sheet 1 as shown in the FIG. 5 flowchart. Consequently, the sheet 1 is in a state being caught in the nip of the transport roller pair 10, as shown in FIG. 7. The step S502 represents a situation that the feed and transport motors 104, 105 are once stopped wherein the sheet 1 is completed in its cooperative transport, i.e. immediately before the movement to the next step.

At the next step S503, with respect to the detection result as to the encoder slits in the drive system of the feed roller 3, determination is made as to the presence/absence and direction of a change caused after terminating the deceleration/stop control. When there is a change or no change in the encoder-slit detection result toward the forward rotation of the feed roller 3 (in the direction of transporting the sheet 1 toward the downstream of the transport path) after a simultaneous stop of the feed and transport motors 104, 105, the FIG. 11 process is terminated. Meanwhile, when there is a change of encoder-slit detection result toward the reverse rotation of the feed roller 3 (in the direction of returning the sheet 1 toward the upstream of the transport path) after a simultaneous stop of the feed and transport motors 104, 105, the process proceeds to step S504. At the step S504, drive start timing is controlled to advance at the feed motor 104 earlier than the transport motor 105.

The deviation amount of drive timing at the step S504 can be defined in terms of the encoder slits or of time. The deviation amount of drive timing can be adjusted in accordance with the reverse rotation amount of the feed roller 3 such that the deviation amount of drive timing increases with an increase in the detected reverse rotation amount of reverse rotation of the feed roller 3.

Figure 12:
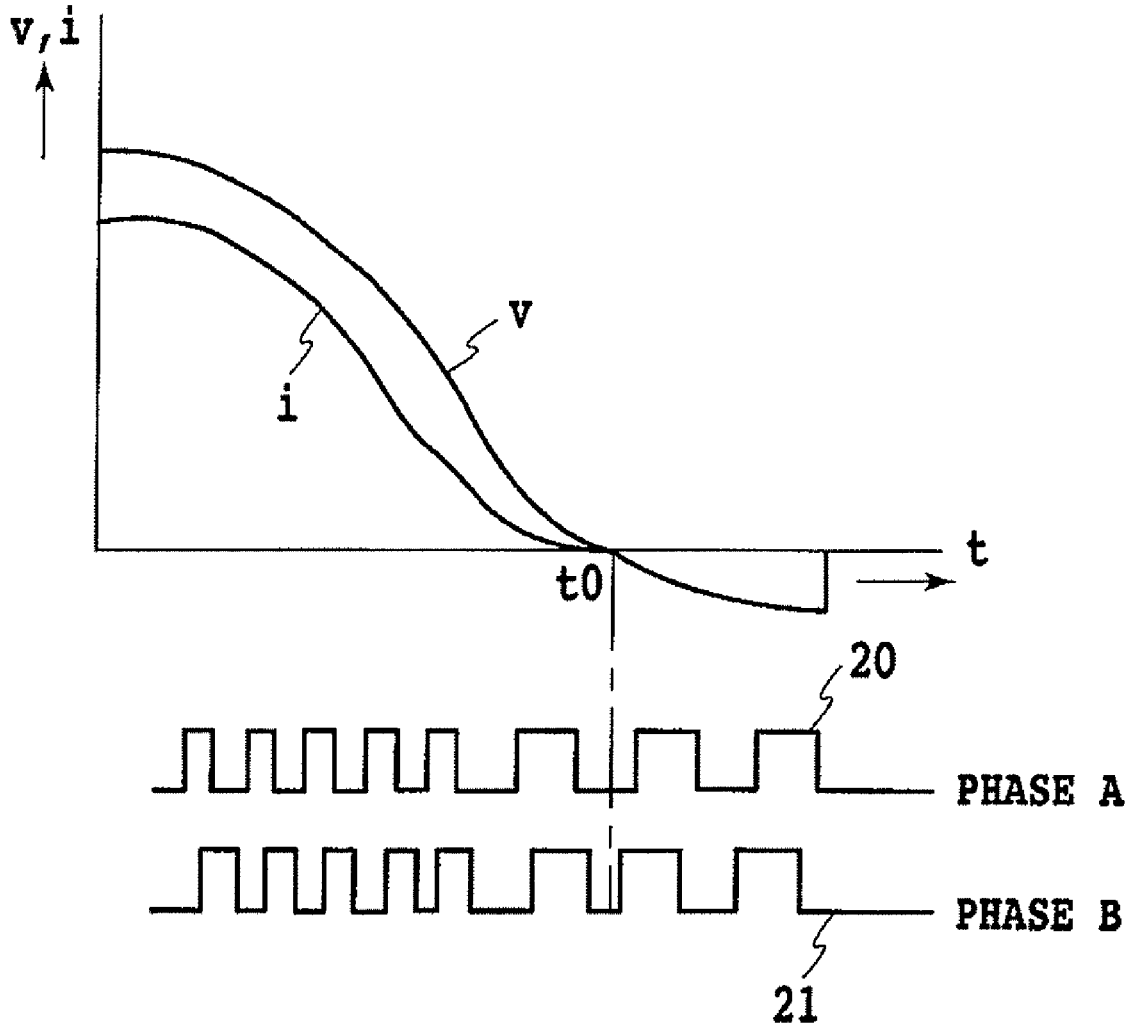
FIG. 12 is an explanatory figure showing an example of a relationship between the rotation after stop of the feed roller of the feed mechanism in FIG. 2 and an encoder output.
Figure 13:
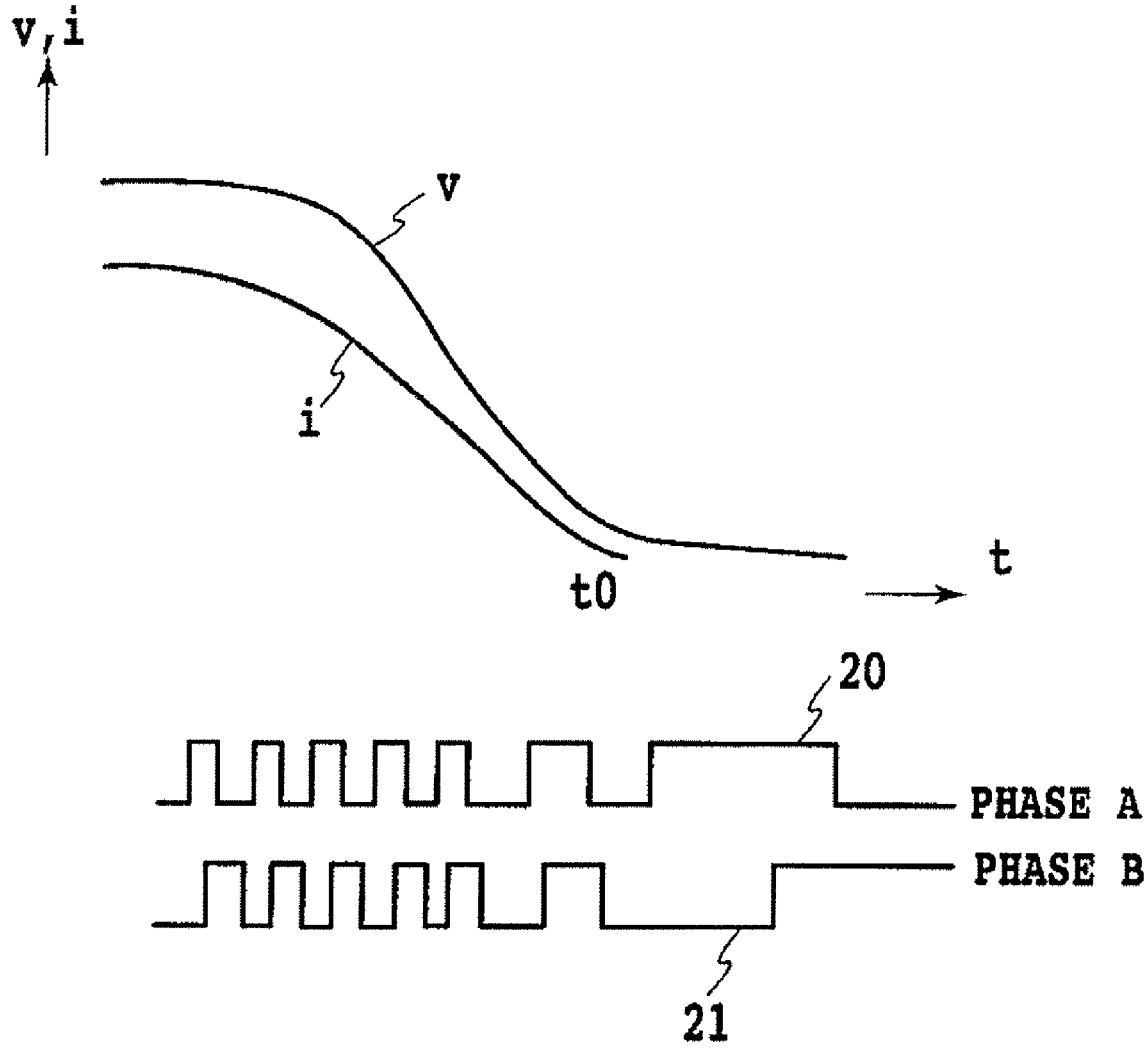
FIG. 13 is an explanatory figure showing another example of the relationship between the rotation after stop of the feed roller of the feed mechanism in FIG. 2 and the encoder output.

FIGS. 12 and 13 show examples in a change of feed motor 104 speed and encoder output, at a completion of cooperative transport. In the figures, time t is taken on the abscissa while a rotation speed v of the feed motor 3 detected by the encoder and an application current i under control are taken on the ordinate.

The encoder is of a two-channel system having phases A and B to be detected in a rotating direction. The outputs 20, 21 in phases A, B from the encoder of the feed motor 104 are compared with a speed v of the feed motor 104. FIG. 12 shows a case that the application voltage i becomes zero at a completion time t0 of the deceleration/stop control on the feed motor 104, followed by reverse rotation of the feed motor 104 thus changing the encoder outputs. FIG. 13 shows a case that the application voltage i becomes zero at a completion time t0 of the deceleration/stop control on the feed motor 104, followed by forward rotation of the feed motor 104 thus changing the encoder outputs.

As apparent from FIGS. 12 and 13, by comparing the phase-A and phase-B outputs 20, 21 with the speed v of the feed motor 104, determination can be made as to whether or not the feed roller 3 has rotated after the deceleration/stop control on the feed motor 104. Furthermore, in the case the feed roller 3 has rotated, determination can be made as to the rotating direction thereof.

Other Embodiments

The invention can be broadly applied as a transport apparatus in various type for transporting a printing medium, wherein the printing medium to transport may be not only an unprinted one but also a printed one. The transport apparatus may be structurally incorporated in a printing apparatus or structurally arranged separately from the printing apparatus.

Meanwhile, where the transport apparatus is incorporated in the printing apparatus, the control function for the transport apparatus may be partly or wholly provided on the printing apparatus or on a host apparatus.

The invention is applicable broadly for various printing apparatuses besides the serial-scan type inkjet printing apparatus. The printing apparatuses, the invention is applicable, includes, say, a full-line type printing apparatus having, in a constant position, an elongate printhead extending over the entire width of a printing medium and for printing an image while transporting the printing medium. Meanwhile, printing is not limited to the inkjet printing system but may be desirably, e.g. in a thermal transfer system.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-227180, filed Aug. 23, 2006, which is hereby incorporated by reference herein in its entirety.

What is claimed is:

1. A transport apparatus for transporting a printing medium through a transport path by cooperation of a first roller located on an upstream side on the transport path and a second roller located on a downstream side on the transport path, the transport apparatus comprising:

a first drive system that drives the first roller by a first drive motor;

a second drive system that drives the second roller by a second drive motor; and control means that places the first and second drive motors under deceleration/stop control respectively to simultaneously stop the first and second rollers from rotating, in a course of transporting the printing medium by cooperation of the first and second rollers;

wherein the control means stops the first drive motor by cutting off a drive current to the first drive motor in a case in which the first roller is rotating when the second roller stops rotating.

2. A transport apparatus for transporting a printing medium through a transport path by cooperation of a first roller located on an upstream side on the transport path and a second roller located on a downstream side on the transport path, the transport apparatus comprising:

a first drive system that drives the first roller by a first drive motor;

a second drive system that drives the second roller by a first drive motor;

control means that places the first and second drive motors under deceleration/stop control respectively to simultaneously stop the first and second roller from rotating, in a course of transporting the printing medium by cooperation of the first and second roller;

wherein the control means stops the first drive motor by terminating the deceleration/stop control on the first drive motor in a case in which the first roller is rotating when the second roller is stops rotating.

3. A transport apparatus for transporting a printing medium through a transport path by cooperation of a first roller located on an upstream side on the transport path and a second roller located on a downstream side on the transport path, the transport apparatus comprising:

a first drive system that drives the first roller by a first drive motor;

a second drive system that drives the second roller by a second drive motor; and control means that places the first and second drive motors under deceleration/stop control respectively to simultaneously stop the first and second roller from rotating, in a course of transporting the printing medium by cooperation of the first and second rollers;

wherein the control means stops the first drive motor in a case in which the first roller is rotating when the second roller stops rotating, wherein the control means completes the deceleration/stop control on the second drive motor in a case in which the first roller is stopped from rotating before a stop of the second roller from rotating.

4. A transport apparatus for transporting a printing medium through a transport path by cooperation of a first roller located on an upstream side on the transport path and a second roller located on a downstream side on the transport path, the transport apparatus comprising:

a first drive system that drives the first roller by a first drive motor;

a second drive system that drives the second roller by a second drive motor; and control means that places the first and second drive motors under deceleration/stop control respectively to simultaneously stop the first and second rollers from rotating, in a course of transporting the printing medium by cooperation from the first and second rollers;

wherein the control means stops the first drive motor in a case in which the first roller is rotating when the second roller stops rotating, and wherein the control means places the first and second drive motors under feedback control on a basis of respective rotation detection signals of the first and second drive motors.

5. A transport apparatus for transporting a printing medium through a transport path by cooperation of a first roller located on an upstream side on the transport path and a second roller located on a downstream side on the transport path, the transport apparatus comprising:

a first drive system that drives the first roller by a first drive system motor;

a second drive system that drives the second roller by a second drive motor; and control means that places the first and second drive motors under deceleration/stop control respectively to simultaneously stop the first and second rollers from rotating, in a course of transporting the printing medium by cooperation of the first and second rollers;

wherein the control means stops the first drive motor in a case in which the first roller is rotating when the second roller stops rotating, wherein the control means advances a drive start time for the first drive motor earlier than the second drive motor upon resuming the transport of the printing medium by the cooperation of the first and second rollers, in a case in which the first roller reverse rotates toward the upstream side of the transport path after stopping the first and second drive motors.

6. A transport apparatus according to claim 5, wherein the control means controls the drive start time of the first drive motor depending upon a reverse rotation amount of the first roller.

7. A transport apparatus according to claim 5, further comprising detecting means that detects an amount and direction of rotation of the first roller, wherein the control means controls the drive start time of the first drive motor depending upon a detection result due to the detecting means.

8. A transport apparatus according to claim 1, wherein the second roller has a transport force, for the printing medium, greater than that of the first roller.

9. A transport method for transporting a printing medium through a transport path by cooperation of a first roller located on an upstream side on the transport path and a second roller located on a downstream side on the transport path, the transport method comprising the steps of:

driving the first roller by a first drive motor;

driving the second roller by a second drive motor;

placing the first and second drive motors under deceleration/stop control respectively to simultaneously stop the first and second rollers from rotating, in a course of transporting the printing medium by cooperation of the first and second rollers; and stopping the first drive motor by cutting off a drive current to the first drive motor in a case in which the first roller is rotating when the second roller stops rotating.

10. A printing apparatus comprising:

a transport apparatus according to claim 1; and a printing portion where an image is to be printed on a printing medium being transported through the transport path.

* * * * *